US009352878B2

(12) United States Patent
Glass et al.

(10) Patent No.: US 9,352,878 B2
(45) Date of Patent: May 31, 2016

(54) STAND UP CARD HOLDER

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/596,019

(22) Filed: Aug. 27, 2012

(65) Prior Publication Data

US 2013/0220843 A1 Aug. 29, 2013

Related U.S. Application Data

(60) Provisional application No. 61/527,137, filed on Aug. 25, 2011.

(51) Int. Cl.
*B65D 73/00* (2006.01)
*B65D 25/00* (2006.01)

(52) U.S. Cl.
CPC ..... *B65D 25/00* (2013.01); *B65D 73/0078* (2013.01)

(58) Field of Classification Search
CPC ..... B65D 73/0078; B65D 73/0007; B65D 73/0021; B65D 73/0064; B65D 73/0071; B42D 15/042; B42D 15/045; B42D 15/00
USPC ..... 206/45.24, 449, 806, 757, 45.23, 767, 206/768, 232; 40/124.06; 229/71
See application file for complete search history.

(56) References Cited

U.S. PATENT DOCUMENTS

| | | | | |
|---|---|---|---|---|
| 3,549,225 | A * | 12/1970 | Scaccia | 312/9.9 |
| 6,059,101 | A * | 5/2000 | Gambardella et al. | 206/308.1 |
| 6,505,737 | B1 * | 1/2003 | Sherman | 206/308.1 |
| 6,732,459 | B1 * | 5/2004 | Clark | 40/124.06 |
| 6,758,333 | B2 * | 7/2004 | Sherman | 206/308.1 |
| 6,877,263 | B2 * | 4/2005 | Clark | 40/124.06 |
| 6,971,524 | B1 * | 12/2005 | Voswinkel | 206/762 |
| 7,490,720 | B2 * | 2/2009 | Cole et al. | 206/232 |
| 7,513,362 | B2 * | 4/2009 | Beyer | 206/312 |
| 7,563,468 | B2 * | 7/2009 | Bougoulas et al. | 426/5 |
| D619,359 | S * | 7/2010 | Pascua et al. | D3/247 |
| 7,938,270 | B2 * | 5/2011 | Davis | 206/768 |
| 8,157,086 | B1 * | 4/2012 | Gallegos et al. | 206/232 |
| 8,807,332 | B1 * | 8/2014 | Pascua et al. | 206/39 |
| 2004/0093773 | A1 * | 5/2004 | Clark | 40/124.06 |
| 2007/0094901 | A1 * | 5/2007 | Kibbe et al. | 40/124.06 |
| 2008/0237317 | A1 * | 10/2008 | Rosendall | 229/102 |
| 2009/0107862 | A1 * | 4/2009 | Pascua et al. | 206/232 |
| 2012/0241348 | A1 * | 9/2012 | Clegg | 206/486 |
| 2012/0260542 | A1 * | 10/2012 | Kibbe et al. | 40/124.06 |
| 2013/0008810 | A1 * | 1/2013 | Smith | 206/307 |
| 2014/0116908 | A1 * | 5/2014 | Beyer et al. | 206/449 |

* cited by examiner

*Primary Examiner* — Steven A. Reynolds
(74) *Attorney, Agent, or Firm* — Polsinelli PC

(57) ABSTRACT

A card holder for holding a transaction card, such as a gift card, in an upright presentation position upon opening the front and back covers of the holder.

23 Claims, 3 Drawing Sheets

STAND UP CARD HOLDER

CROSS REFERENCE TO RELATED APPLICATIONS

This application claims the benefit of the prior filed, provisional application, Ser. No. 61/527,137, filed Aug. 25, 2011, incorporated by reference herein.

BACKGROUND OF THE INVENTION

This invention relates generally to transaction card holders and more particularly to holder for holding a transaction card, such as a gift card, in an upright presentation position upon opening the front and back covers of the holder.

Transaction cards, stored value cards, or gift cards, as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or, more commonly, is selected at the point of sale by the purchaser and loaded by the cashier using a magnetic card reader/writer. While popular, gift cards are typically provided with a generic and impersonal design, typically identifying the associated merchant for which the card may be used to purchase merchandise, and therefore are not personalized in view of the intended recipient.

Gift cards are often presented for sale on display racks in stores, each card or packet of cards being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets.

In addition to the above considerations, gift card packets must fit within a set, allocated space in pre-existing displays. A gift card packet must not exceed 5.25" tall and 4" wide. These dimensions are an industry standard and are typically non-negotiable. In order to properly hang each gift card packet, the packet typically includes a J-hook hole (sombrero cut) with the exact dimensions of 1.875" wide by 0.5" high and be placed 0.1875" from the top of the packet. Presently, the above requirements pertain to approximately 95% of all gift cards and gift card packets that are sold at retail.

What is needed, therefore, is a device that displays a gift card for purchase when hung upon a display rack within a predetermined and allotted display space but that converts to an enhanced gifting assembly after purchase, removal of the header panel, and installation of the gift card within the assembly.

BRIEF DESCRIPTION OF THE INVENTION

The purpose of this invention is to provide a card holder for holding a transaction card, such as a gift card, in an upright presentation position upon opening the front and back covers of the holder. The design of the holder mimics a small book in that it has a front and back cover and that the gift card may be positioned within the holder to mimic a page. Interior panels of the holder meet at the center fold line to form a pocket for receiving the gift card.

Other advantages of the invention will become apparent from the following description taken in connection with the accompanying drawings, wherein is set forth by way of illustration and example an embodiment of the present invention.

DETAILED DESCRIPTION

Figure 1:
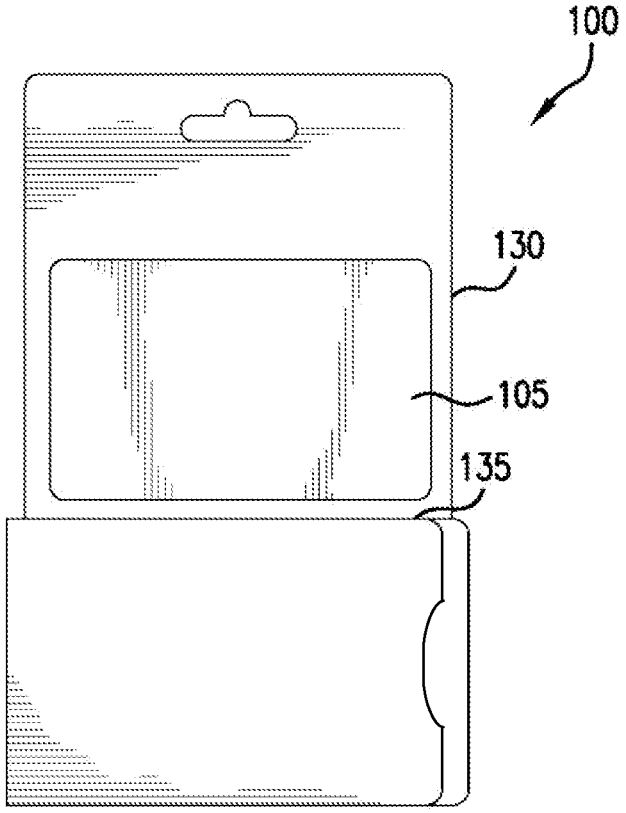
FIG. 1 is a front elevation showing the card holder in a closed disposition for display upon a merchant display rack.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

With reference to the figures, FIGS. 1-4 are illustrations of one or more embodiments of a card holder 100 for holding transaction cards, such as a gift card 105, in an upright presentation position upon opening the front 110 and back 115 covers of the holder 100. The design of the holder 100 mimics a small book in that the gift card 105 may be positioned within the holder 100 to mimic a page. Interior panels 110*a* and 115*a* of the holder 100 meet at the center fold line 120 to form a pocket 125 for receiving the gift card 105.

Figure 3:
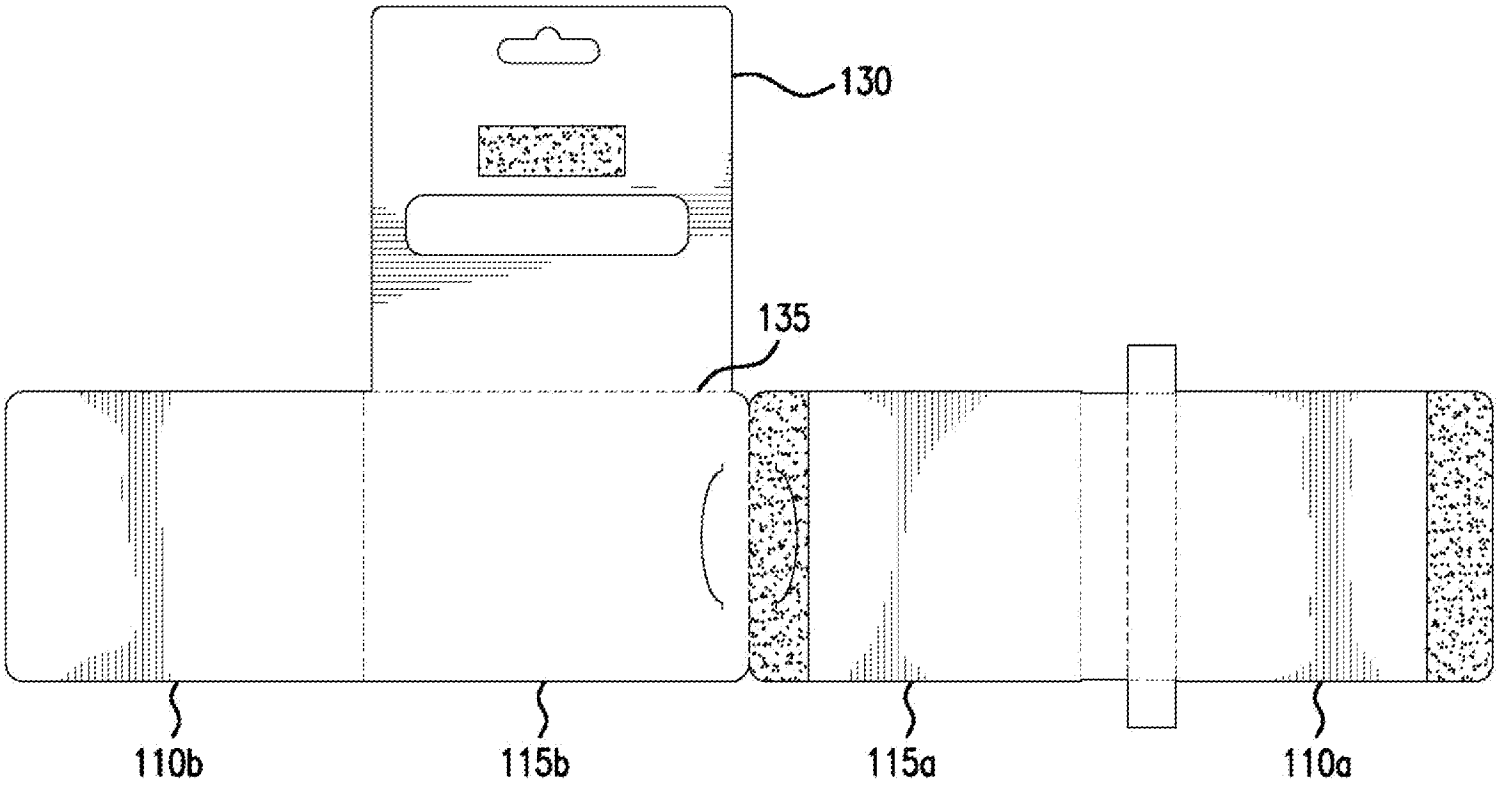
FIG. 3 is a plan view of a first side of an unassembled card holder.
Figure 4:
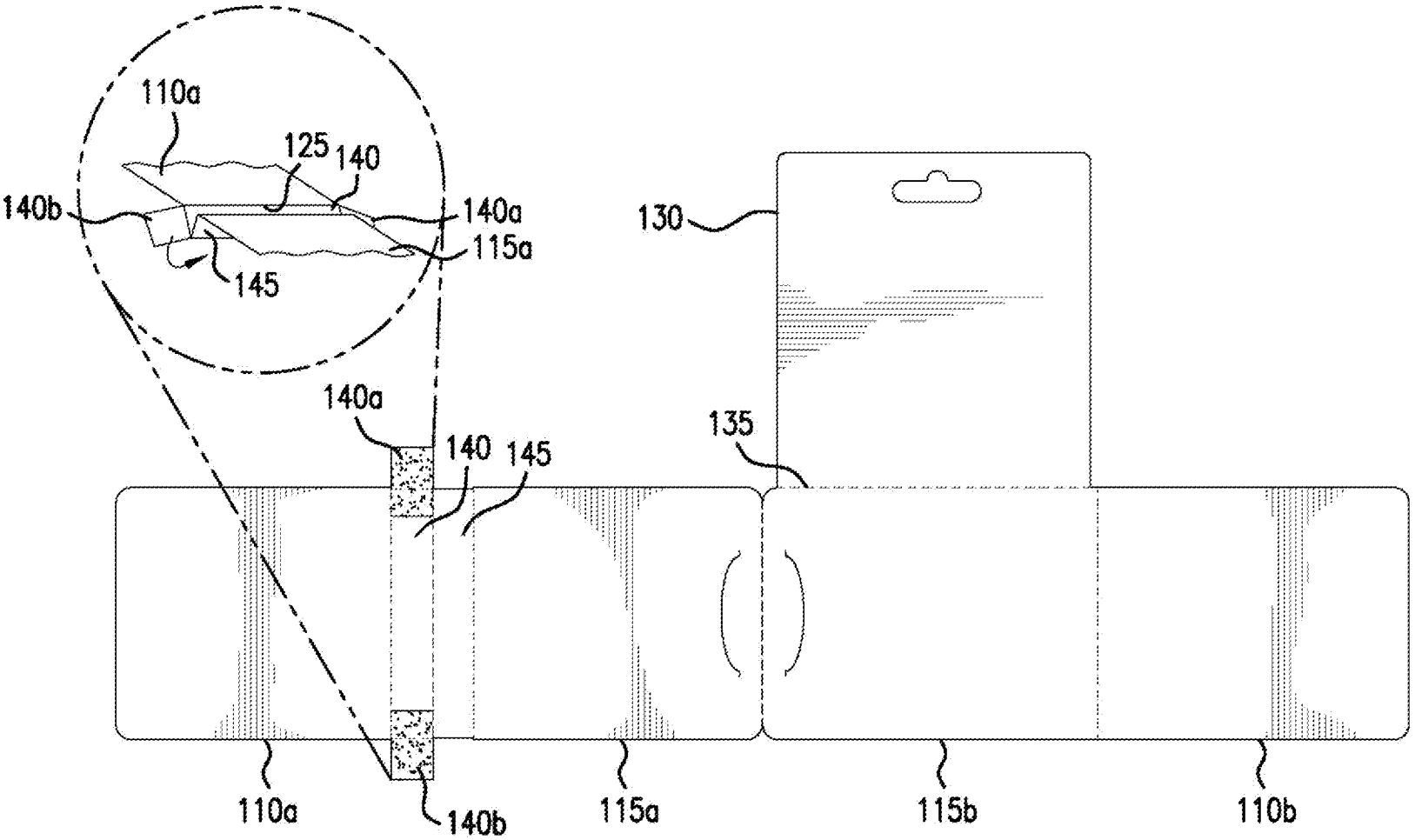
FIG. 4 is a plan view of a second side of an unassembled card holder.

FIG. 1 is a front elevation showing the card holder 100 in a closed disposition for display upon a merchant display rack (not shown). The holder 100 includes a header panel 130 that projects upward from one of two outer cover panels 110*b* or 115*b* (the header panel 130 extends upward from panel 115*b* as shown in FIGS. 3 and 4. A perforation line 135 typically divides the header panel 130 from the other panels of the holder 100 so that the header panel 130 may be readily torn or cut or otherwise removed from the holder 100 after purchase. Typically, after purchase of the holder 100 the gift card 105 is removed from the header panel 130 and inserted into the pocket 125 and the header panel 130 is removed and discarded.

Figure 2:
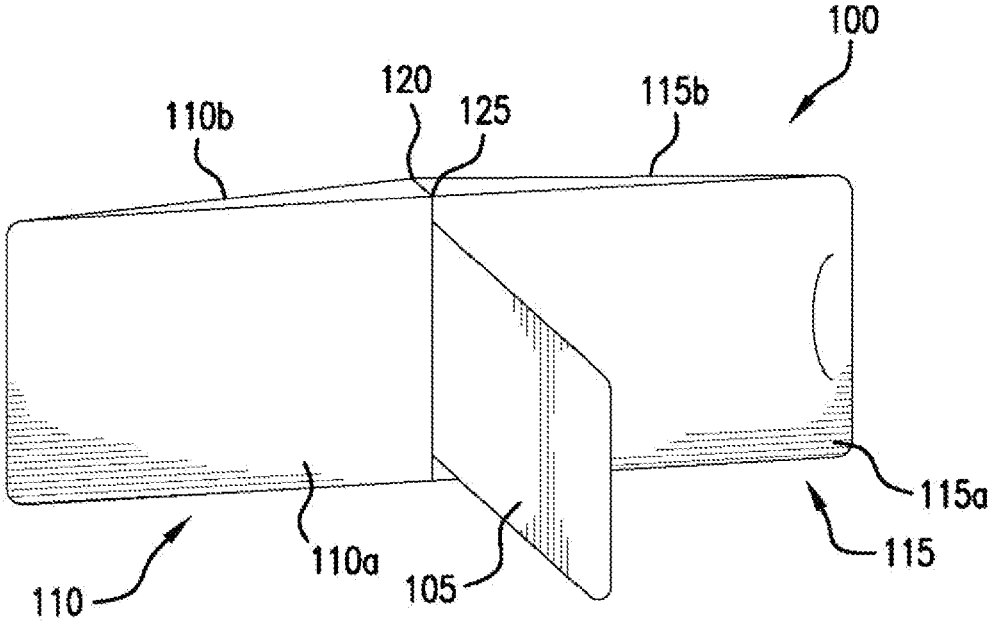
FIG. 2 is a front perspective view showing the card holder in an open disposition.

FIG. 2 is a front perspective view showing the card holder 100 in an open disposition with the gift card 105 received within the pocket 125 and extending outward in a presentation position. FIG. 3 is a plan view of a first side of an unassembled card holder 100. FIG. 4 is a plan view of a second side of an unassembled card holder 100. As shown in FIG. 4, the pocket 125 is formed by folding two subpanels 140 and 145 together and attaching subpanel 140 to subpanel 145 by adhering two tabs 140*a* and 140*b* extending transversely from subpanel 140 to proximate portions of subpanel 145.

Having thus described the invention, what is claimed as new and desired to be secured by Letters Patent is:

1. A gift card holder comprising:

a front cover;

a back cover, wherein the front cover is hingedly engaged to the back cover along a cover fold line;

a first interior panel;

a second interior panel; and a pocket to receive a gift card, the pocket defined by a first pocket subpanel hingedly engaged to a second pocket subpanel along a pocket fold line, wherein the first pocket panel is engaged to the first interior panel and the second pocket panel is engaged to the second interior panel;

wherein when the front cover is pivoted about the cover fold line away from the back cover, a gift card disposed within the pocket pivots away from the second interior panel and projects away from the pocket; and wherein the gift card is initially removably attached to a removable header panel extending away from the front cover or the back cover, wherein the gift card is removed from the header and positioned within the pocket.

2. The gift card holder of claim 1 where, in a closed configuration, an internal face of the first interior panel is disposed proximal to an internal face of the second interior panel, and the internal face of the first interior panel is pivoted away from the internal face of the second interior panel to provide an open configuration.

3. The gift card holder of claim 1 where the first interior panel is engaged to an interior front cover surface and the second interior panel is engaged to an interior back cover surface, and wherein the pocket fold line is aligned with the cover fold line.

4. The gift card holder of claim 1 where the gift card holder comprises a planar material.

5. The gift card holder of claim 1 where the second interior panel comprises a slot to receive a peripheral edge of the front cover when in a closed configuration.

6. The gift card holder of claim 1 where the back cover comprises a slot to receive a peripheral edge of the front cover when in a closed configuration.

7. The gift card holder of claim 1 where the back cover and the second interior panel comprise co-aligned slots to receive a peripheral edge of the front cover when in a closed configuration.

8. A gift card holder comprising:

a front cover;

a back cover, wherein the front cover is hingedly engaged to the back cover along a cover fold line;

a first interior panel;

a second interior panel;

a pocket to receive a gift card, the pocket defined by a first pocket subpanel hingedly engaged to a second pocket subpanel along a pocket fold line, wherein the first pocket panel is engaged to the first interior panel and the second pocket panel is engaged to the second interior panel;

one or more tabs hingedly engaged to and extending transversely away from the first pocket subpanel; and where the one or more tabs engage proximal portions of the second pocket subpanel; and wherein when the front cover is pivoted about the cover fold line away from the back cover, a gift card disposed within the pocket pivots away from the second interior panel and projects away from the pocket.

9. The gift card holder of claim 8 further comprising a header panel removably engaged to the front cover or the back cover.

10. The gift card holder of claim 8 where, in a closed configuration, an internal face of the first interior panel is disposed proximal to an internal face of the second surface interior panel, and the internal face of the first interior panel is pivoted away from the internal face of the second surface interior panel to provide an open configuration.

11. The gift card holder of claim 8 where the first interior panel is engaged to an interior front cover surface and the second interior panel is engaged to an interior back cover surface, and wherein the pocket fold line is aligned with the cover fold line.

12. The gift card holder of claim 8 where the gift card holder comprises a planar material.

13. The gift card holder of claim 8 where the second interior panel comprises a slot to receive a peripheral edge of the front cover when in a closed configuration.

14. The gift card holder of claim 8 where the back cover comprises a slot to receive a peripheral edge of the front cover when in a closed configuration.

15. The gift card holder of claim 8 where the back cover and the second interior panel comprise co-aligned slots to receive a peripheral edge of the front cover when in a closed configuration.

16. A gift card holder comprising:

a front cover;

a back cover, wherein the front cover is hingedly engaged to the back cover along a cover fold line;

a first interior panel;

a second interior panel;

a pocket to receive a gift card, the pocket defined by a first pocket subpanel hingedly engaged to a second pocket subpanel along a pocket fold line, wherein the first pocket panel is engaged to the first interior panel and the second pocket panel is engaged to the second interior panel;

one or more tabs hingedly engaged to and extending transversely away from the second pocket subpanel; and where the one or more tabs engage proximal portions of the first pocket subpanel; and wherein when the front cover is pivoted about the cover fold line away from the back cover, a gift card disposed within the pocket pivots away from the second interior panel and projects away from the pocket.

17. The gift card holder of claim 16 further comprising a header panel removably engaged to the front cover or the back cover.

18. The gift card holder of claim 16 where, in a closed configuration, an internal face of the first interior panel is disposed proximal to an internal face of the second surface interior panel, and the internal face of the first interior panel is pivoted away from the internal face of the second surface interior panel to provide an open configuration.

19. The gift card holder of claim 16 where the first interior panel is engaged to an interior front cover surface and the second interior panel is engaged to an interior back cover surface, and wherein the pocket fold line is aligned with the cover fold line.

20. The gift card holder of claim 16 where the gift card holder comprises a planar material.

21. The gift card holder of claim 16 where the second interior panel comprises a slot to receive a peripheral edge of the front cover when in a closed configuration.

22. The gift card holder of claim 16 where the back cover comprises a slot to receive a peripheral edge of the front cover when in a closed configuration.

23. The gift card holder of claim 16 where the back cover and the second interior panel comprise co-aligned slots to receive a peripheral edge of the front cover when in a closed configuration.

* * * * *